US006200252B1

(12) United States Patent
Hallgren et al.

(10) Patent No.: US 6,200,252 B1
(45) Date of Patent: Mar. 13, 2001

(54) REACTION-DRIVEN CENTRIFUGAL ROTOR WITH OUTLET CHAMBER ENTRAINMENT MEMBERS

(75) Inventors: Ingvar Hallgren, Tumba; Hans Moberg, Stockholm; Leif Larsson, Tumba, all of (SE)

(73) Assignee: Alfa Laval AB, Tumba (SE)

( * ) Notice: Subject to any disclaimer, the term of this patent is extended or adjusted under 35 U.S.C. 154(b) by 0 days.

(21) Appl. No.: 09/345,235

(22) Filed: Jun. 30, 1999

(30) Foreign Application Priority Data

Mar. 30, 1999 (SE) ..... 9901159

(51) Int. Cl.[7] ..... B04B 9/06; B04B 1/04

(52) U.S. Cl. ..... 494/49; 494/75

(58) Field of Search ..... 494/24, 36, 43, 494/49, 64, 65, 67, 84, 901, 75; 210/168, 171, 232, 360.1, 380.1, 416.5; 184/6.24

(56) References Cited

U.S. PATENT DOCUMENTS 4,787,975 * 11/1988 Purvey ..... 210/360.1
5,637,217 * 6/1997 Herman et al. ..... 494/49
5,683,342 * 11/1997 McNair ..... 494/49
5,707,519 * 1/1998 Miller et al. ..... 494/49
5,785,849 7/1998 Mules .

FOREIGN PATENT DOCUMENTS 0 728 042 B1 6/1998 (EP) .
633609 * 11/1978 (SU) ..... 494/901
WO 97/23296 7/1997 (WO) .

* cited by examiner

*Primary Examiner*—Charles E. Cooley
(74) *Attorney, Agent, or Firm*—Fish & Richardson P.C.

(57) ABSTRACT

In a reaction-driven centrifugal rotor the interior of its casing is divided into one separation chamber (11) and one outlet chamber (12). The separation chamber (11) has an inlet (8) for pressurized liquid to be treated in the centrifugal rotor, and the outlet chamber (12) has outlets (24) for treated liquid. The outlets (24) extend out through one end wall (1) of the casing from the outlet chamber to the outside of the casing. They are situated at a distance from the rotational axis (R) of the centrifugal rotor and directed in a way such that the centrifugal rotor is subjected to a reaction force in its circumferential direction, when liquid flows out therethrough. An annular partition (9) arranged coaxially with the centrifugal rotor within the casing separates the separation chamber (11) from the outlet chamber (12). However, the two chambers communicate with each other through a space at the radially inner edge of the partition (9). The invention is concerned with liquid entrainment members (25, 26), which are arranged in the outlet chamber (12) and formed in a way such that they impede liquid flow in the circumferential direction of the centrifugal rotor relative to the centrifugal rotor. Preferably, there is at least one liquid entrainment member (25), which in a part of the outlet chamber (25) substantially completely prevents liquid flow relative to the centrifugal rotor in the circumferential direction thereof.

13 Claims, 2 Drawing Sheets

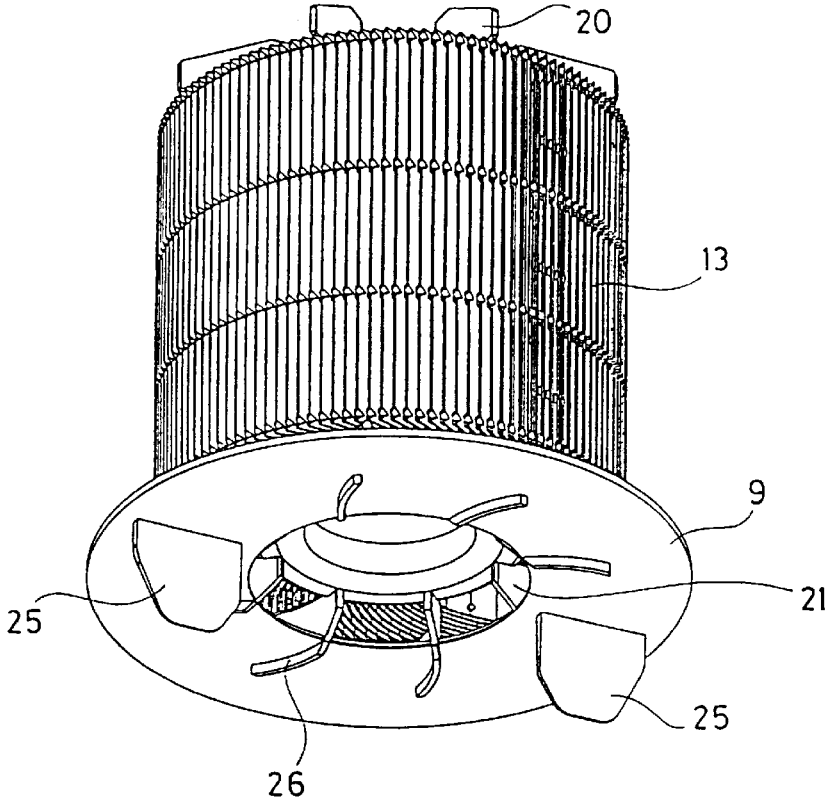
Fig.2
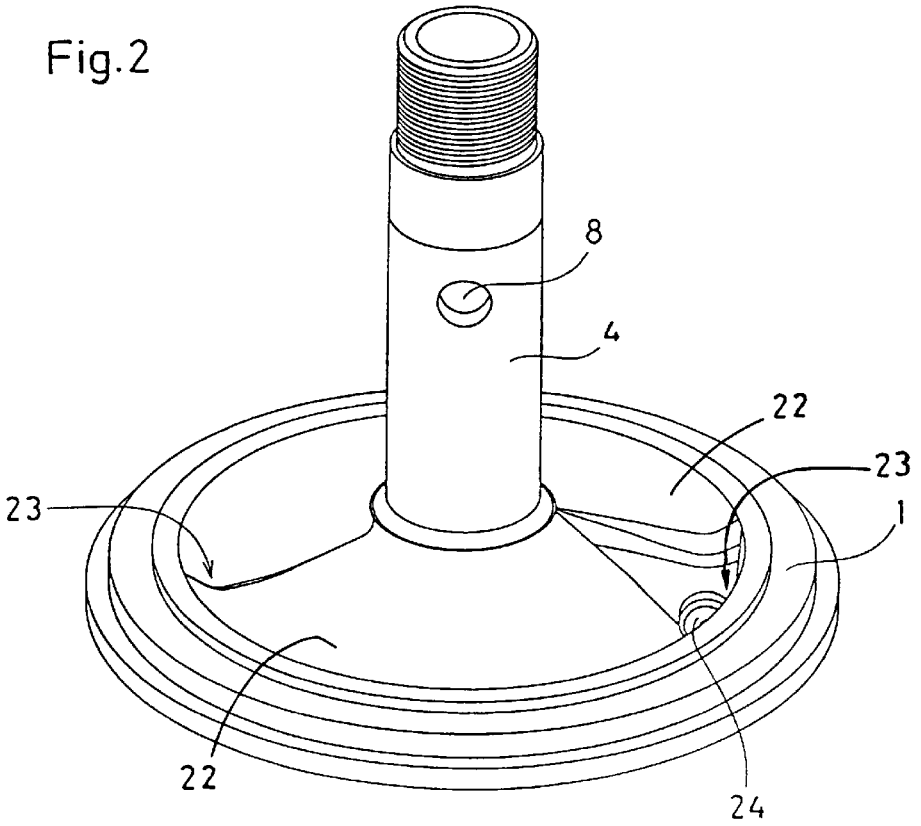

REACTION-DRIVEN CENTRIFUGAL ROTOR WITH OUTLET CHAMBER ENTRAINMENT MEMBERS

The present invention relates to centrifugal rotors for cleaning of a liquid from solid or liquid particles suspended therein. More particularly the invention concerns a centrifugal rotor for this purpose, which comprises a casing surrounding both a separation chamber and an outlet chamber and including two axially spaced end walls and a surrounding wall situated axially therebetween; an annular partition arranged within the casing coaxially with the rotor in a way such that its one side faces axially towards said separation chamber, which is situated between the partition and one of said end walls, and its other side faces towards said outlet chamber, which is situated between the partition and the other one of said end walls, the separation chamber communicating with the outlet chamber through a space at a radially inner part of the partition; an inlet device adapted to receive pressurized liquid to be cleaned and to conduct this into the separation chamber; and an outlet device for discharging cleaned liquid from the rotor through outlets which are situated at a distance from its rotational axis and are directed in a way such that the rotor upon outflow of liquid through the outlets is subjected to a reaction force in its circumferential direction, the casing on parts of its inside delimiting the outlet chamber having two or more niches, which are situated at a distance from each other seen in the circumferential direction of the rotor and from which said outlet starts. The niches are usually formed in said other one of the casing end walls but can alternatively be formed in the surrounding wall of the casing.

BACKGROUND OF THE INVENTION

Centrifugal rotors of this kind are known for instance through EP 0728042 B1, U.S. Pat. No. 5,683,342, U.S. Pat. No. 5,707,519 and WO 97/23296.

SUMMARY OF THE INVENTION

The object of the present invention is to make possible by simple means an improvement of the separation efficiency of a centrifugal rotor of the defined kind.

For obtaining of this object the invention suggests that a centrifugal rotor of the initially defined kind is provided with at least one liquid entrainment member arranged between the partition and said other one of the end walls of the centrifugal rotor for entrainment in the centrifugal rotor rotation of liquid present the outlet chamber.

By such entrainment of liquid, which is on its way radially outwardly in the outlet chamber to the level of said outlets, large slipping or sliding losses may be avoided. Hereby, it is achieved that a larger part than otherwise of the overpressure which the liquid has in the centrifugal rotor may be used for the driving of the centrifugal rotor, i.e. a somewhat higher rotational speed of the centrifugal rotor can be achieved.

Liquid entrainment members may be formed in different ways for achievement of the desired result. Preferably, liquid entrainment members may be used having mutually different forms.

Preferably, a liquid entrainment member is formed such that in the area thereof in the outlet chamber it substantially completely prevents liquid flow relative to the rotor in the circumferential direction thereof. The liquid entrainment member may have the form of a wing or the like.

In a preferred embodiment of the invention a liquid entrainment member of the kind just mentioned is arranged in the area of each one of said niches, covering substantially the whole flow area in the outlet chamber, seen in the circumferential direction of the centrifugal rotor. Preferably, the liquid entrainment member extends also out into the relevant niche. Alternatively, the liquid entrainment member may be arranged adjacent to the niche, either in front of or behind it, seen in the rotational direction of the centrifugal rotor.

In the areas between the niches, seen in the circumferential direction of the centrifugal rotor, spaces have to be present for liquid flow to and into the niches from various parts of the outlet chamber. If desired, liquid entrainment members may be present also in these areas, but in this case they should only impede and not prevent liquid flow in the circumferential direction of the centrifugal rotor.

If no liquid entrainment members are arranged to substantially completely prevents liquid flow in the circumferential direction of the centrifugal rotor, e.g. in the areas of said niches, several liquid entrainment members distributed around the rotational axis of the centrifugal rotor may be adapted to accomplish together a desired sliding or slipping preventing effect in the outlet chamber.

Liquid entrainment members, which do not bridge the whole distance between the partition and said other one of the end walls of the casing, preferably extend in a radial direction from the inner edge of the partition only out to the radial level at which the outlets of the centrifugal rotor are situated in said niches.

All of the liquid entrainment members are preferably formed in one piece with said partition. Alternatively, they may of course be formed in one piece with some part of the casing or be carried by a separate annular member arranged in the outlet chamber between the partition and the casing end wall.

BRIEF DESCRIPTION OF THE DRAWINGS

The invention is described in the following with reference to the accompanying drawing, in which FIG. 1 shows an axial section through a centrifugal rotor according to the invention and FIG. 2 shows two separated parts of the centrifugal rotor according to FIG. 1 in a perspective view.

DETAILED DESCRIPTION

Figure 1:
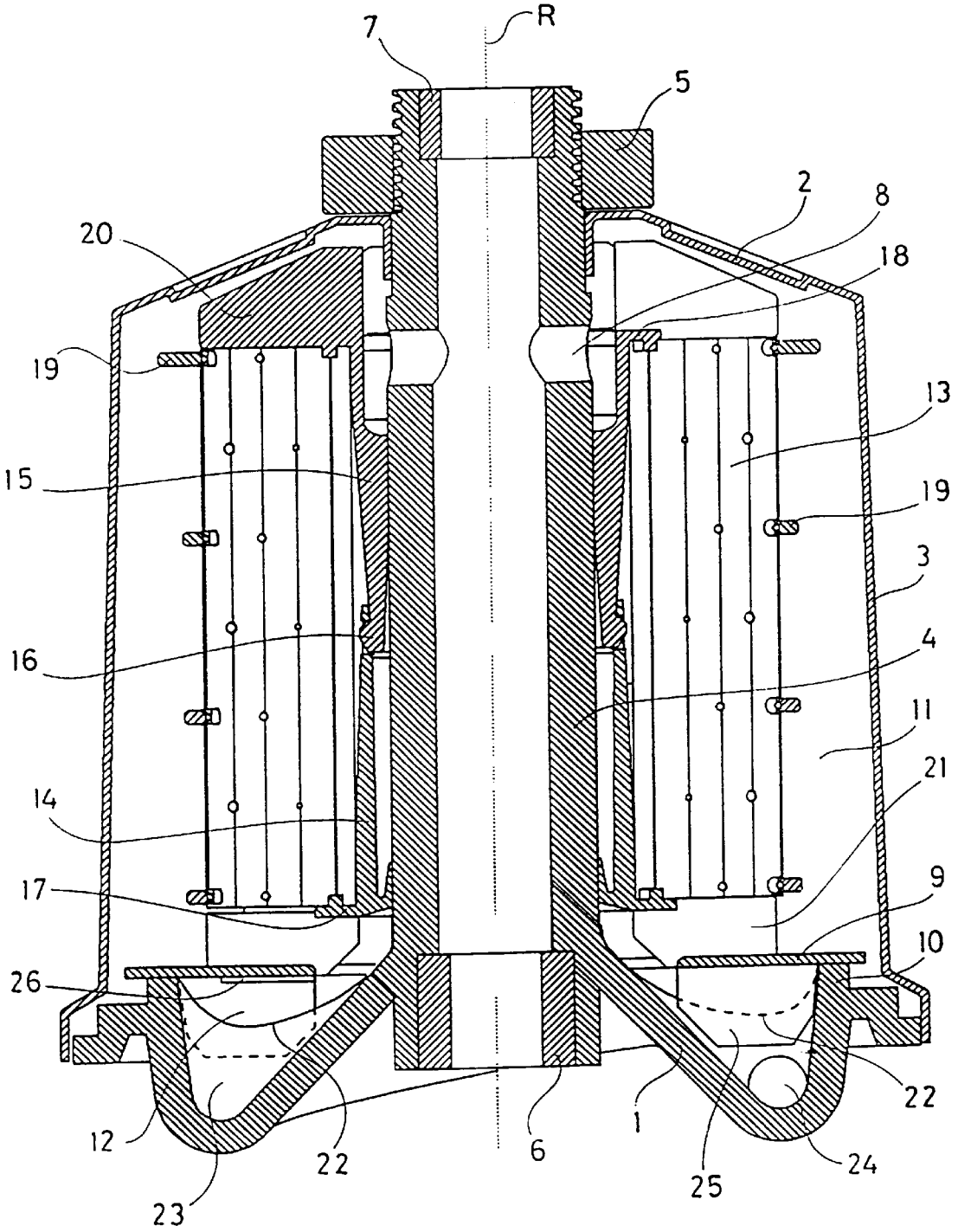

The centrifugal rotor shown in the drawing is rotatable around a rotational axis R, which also constitutes the center axis of the centrifugal rotor. The centrifugal rotor comprises an outer casing consisting of a lower end wall 1 and a cap which includes an upper end wall 2 and a surrounding wall 3.

The lower end wall 1 supports a central tubular column 4, which extends up through the whole of the centrifugal rotor and through an opening in the upper end wall 2. The end wall 2 and the surrounding wall 3 are maintained fixed against the end wall 1 by means of a nut 5, which is threaded onto the upper part of the column 4.

The reference numerals 6 and 7 in FIG. 1 concern schematically shown parts of a bearing device, by means of which the centrifugal rotor can be journalled rotationally on a stationary shaft (not shown), through which liquid to be treated in the centrifugal rotor may be supplied. As can be seen from FIG. 1, the central tubular column 4 has two openings 8 for introduction of liquid of this kind into the centrifugal rotor.

Within said casing the centrifugal rotor has an annular partition 9, which by its radially outermost part abuts against an annular flange 10 of the lower end wall 1. The partition 9 divides the interior of the centrifugal rotor into one separation chamber 11 and one outlet chamber 12.

In the separation chamber 11 there is mounted a separation device including a large number of separation discs 13. Each one of these extends both axially and arcuately from a small to a larger radius in the separation chamber 11. The separation discs 13 are mounted in a supporter, which comprises a lower supporting member 14 and an upper supporting member 15. The supporting members 14 and 15 have sleeve-formed parts, which surround and are guided by the column 4 and are connected to each other by means of an openable snap-lock device 16. The supporting members 14 and 15 further have annular flanges 17 and 18, respectively, by means of which they engage with the separation discs 13 through recesses in the axial end portions thereof near the column 4. The separation discs 13 are also kept fixed relative to each other by means of several rings 19 arranged at different axial levels and extending around the separation discs.

The upper supporting member 15 is provided with several axially and radially extending wings 20, which are distributed around the column 4. Two of the wings 20 extend radially all the way from the column 4 in the area of the openings 8 to the radially outermost parts of the separation discs 13, whereas the other wings 20 extend mainly from the radially inner to the radially outer edges of the separation discs 13. All of the wings 20 extend substantially radially, i.e. they form an angle with the arcuate separation discs 13.

Also in the area between the separation discs 13 and the partition 9 there are arranged wings 21, which extend partly axially and partly radially or arcuately between the radially inner and outer edges of the separation discs. Even the wings 21, which are distributed around the column 4, form an angle with the separation discs 13.

As indicated by arcuate lines 22 in FIG. 1 and as can be seen from FIG. 2, the end wall 1 forms a groove, which extends around the column 4 and forms within the centrifugal rotor the main part of said outlet chamber 12. In the form of depressions in this groove the end wall has two niches 23 situated at diametrically opposite sides of the column 4. In each one of these niches, which form parts of the outlet chamber 12, there is formed an outlet 24 extending through the end wall 1 to its outside and directed substantially tangentially to a circle extending around the rotational axis R of the centrifugal rotor. Each niche 23 has a limited extension in the circumferential direction of the rotor and has a rear limiting wall, seen in the rotational direction of the centrifugal rotor, through which the outlet 24 extends. Whereas this rear limiting wall extends substantially perpendicular to the partition 9, the front limiting wall of the niche forms an acute angle with the partition 9.

As can be seen from FIG. 2, the partition 9 has on its underside two substantially axially and radially extending wings 25. Each one of these wings extends, as can be seen from FIG. 1, into one of the niches 23, where it is situated close to or abutting against the rear limiting wall of the niche, seen in the rotational direction of the centrifugal rotor. The wing 25 extends into the niche 23 only so far that it does not cover the outlet 24.

In addition to the wings 25 the partition 9 has on its underside also a number of radial ribs 26 distributed around the column 4 and extending only a small distance axially into the outlet chamber 12. The ribs 26 extend from the radially inner edge of the partition 9 outwardly to about the same radial level at which the outlets 24 are situated.

The centrifugal rotor according to the invention operates in the following manner.

Liquid, e.g. oil, which is to be freed from particles suspended therein, e.g. soot particles having a larger density than the liquid, is supplied to the separation chamber 11 at an overpressure through the interior of the column 4 and through the inlet openings 8. The liquid is distributed evenly around the column 4 by the wings 20 and flows radially outwardly therebetween. After this, the liquid flows axially through the channels, which are formed between the separation discs 13, to the spaces between the wings 21, which are situated between the separation discs 13 and the partition 9. The liquid then flows towards the column 4 and leaves the separation chamber 11 at the radially inner edge of the partition 9. Through a space between the column 4 and the radially inner edge of the partition 9 the liquid enters the outlet chamber 12. In the outlet chamber 12 the liquid finds its way to the niches 23 and out through the outlets 24. Through the reaction force coming up when the liquid leaves the centrifugal rotor through the outlets 24 the centrifugal rotor is brought into and is kept in rotation.

Upon its passage between the wings 20 the liquid is entrained by the wings 20 in the rotation of the rotor. Upon its passage between the separation discs 13 said particles are separated from the liquid by means of the centrifugal force. Since the separation discs 13 extend arcuately towards the periphery of the centrifugal rotor, the particles in each interspace between the separation discs 13 are forced to move to the surface of a separation disc 13. Thereafter the particles slide on this surface towards the outer edge of the separation disc, from where they move further away from the rotational axis of the centrifugal rotor and finally deposit on the inside of the surrounding wall 3 of the casing.

When liquid having been freed from particles has flowed through the channels between the separation discs 13, it flows in a direction towards the central column 4 between the wings 21. Thanks to the wings 21 the liquid is then prevented from increasing its angular velocity.

Through said space at the inner edge of the partition 9 the cleaned liquid is conducted into the outlet chamber 12 evenly distributed around the column 4. Part of the liquid then flows directly from the inner edge of the partition 9 to the two niches 23, whereas the rest of the liquid flows into the other parts of the outlet chamber 12.

Thanks to the presence of the two wings 25, which extend out into the respective niches 23, unimpeded liquid flow is prevented in the outlet chamber 12 in the circumferential direction of the centrifugal rotor. Instead, liquid entering the outlet chamber 12 is pumped substantially radially outwardly by the wings 25 as well as the ribs 26. Despite the ribs 26 not having a particularly large extension axially, they have a substantial rotational entraining effect on liquid present in the outlet chamber 12 axially opposite to the annular space around the column 4, in which the ribs extend radially.

In the area radially outside the ribs 26 the liquid may flow in the circumferential direction of the centrifugal rotor to the respective niches 23. Even in the other parts of the outlet chamber 12 liquid flows in the circumferential direction, however, towards the respective niches 23.

What is claimed is:

1. A centrifugal rotor for cleaning of a liquid from solid or liquid particles suspended therein, said centrifugal rotor being rotatable around a rotational axis (R) and comprising a casing, said casing surrounding both a separation chamber (11) and an outlet chamber (12) and comprising two axially spaced end walls (1, 2) and a surrounding wall (3) situated axially therebetween, an annular partition (9) arranged within the casing coaxially with the rotor in a way such that one side of the partition faces axially towards said separation chamber (11), which is situated between the partition (9) and one of said end walls (1, 2), and the other side of the partition faces towards said outlet chamber (12), said outlet chamber being situated between the partition (9) and the other one of said end walls (1, 2), the separation chamber (11) communicating with the outlet chamber (12) through a space at the radially inner part of the partition (9), an inlet device (4, 8) adapted to receive pressurized liquid to be cleaned and to conduct said liquid into the separation chamber (11), and an outlet device for discharging cleaned liquid from the rotor through outlets (24), said outlets being situated at a distance from the rotational axis (R) of the rotor and being directed in a way such that the rotor upon outflow of liquid through the outlets (24) is subjected to a reaction force in the circumferential direction of the rotor, the casing on the inside of the rotor delimiting the outlet chamber (12) having two or more niches (23) situated at a distance from each other seen in the circumferential direction of the rotor and from which said outlets (24) start, wherein at least one liquid entrainment member (25) is arranged between the partition (9) and said other one of the end walls (1, 2) of the centrifugal rotor for entrainment in the rotation of the centrifugal rotor of liquid present in the outlet chamber (12), said at least one liquid entrainment member (25) being formed such that it extends across substantially the whole flow area in the outlet chamber (12), seen in the circumferential direction of the centrifugal rotor, and thereby substantially completely prevents liquid flow in the outlet chamber relative to the rotor in the circumferential direction of the rotor.

2. A centrifugal rotor according to claim 1, in which said at least one liquid entrainment member (25) has the form of a wing.

3. A centrifugal rotor according to claim 1, in which the at least one liquid entrainment member (25) is arranged for each one of said niches (23), covering substantially the whole flow area in the outlet chamber (12), seen in the circumferential direction of the centrifugal rotor.

4. A centrifugal rotor according to claim 3, in which each of the at least one liquid entrainment members (25) is arranged in the area of one of the niches (23).

5. A centrifugal rotor according to claim 4, in which each of the at least one liquid entrainment members (25) extends out into one of the niches (23).

6. A centrifugal rotor according to claim 5, in which each said niche (23) has a front and a rear part, seen in the rotational direction of the rotor, and one of said outlets (24) starts from the rear part of the niche, the respective at least one liquid entrainment member (25) extending out into said rear part of the niche (23).

7. A centrifugal rotor according to claim 6, in which each said niche (23) has a rear limiting wall, seen in the rotational direction of the centrifugal rotor, and the respective at least one liquid entrainment member (25) abuts against the rear limiting wall, so that liquid present in the niche (23) and between the niche and the partition (9) is entrained in the rotation of the rotor.

8. A centrifugal rotor according to claim 1, in which additional entrainment members (26) are arranged in said outlet chamber (12), the total number of said at least one liquid entrainment member and said additional entrainment members (25, 26) being more in number than said niches (23) and being distributed around said rotational axis (R).

9. A centrifugal rotor according to claim 8, in which at least some of the liquid entrainment members are situated in areas between adjacent niches (23), seen in the circumferential direction of the centrifugal rotor.

10. A centrifugal rotor according to claim 9, in which the outlet chamber (12) has a shape between adjacent niches (23) such that liquid flow is admitted relative to the circumferential direction of the centrifugal rotor, the additional liquid entrainment members (26) being arranged in this part of the outlet chamber (12) to impede such a liquid flow.

11. A centrifugal rotor according to claim 1, in which for each one of the niches (23) an at least one said liquid entrainment member (25) extends out into the niche and substantially completely prevents liquid flow in the outlet chamber (12) relative to the circumferential direction of the centrifugal rotor, in addition to which for each area between two adjacent niches (23), seen in the circumferential direction of the rotor, at least one additional liquid entrainment member (26) is formed in a way such that the additional liquid entrainment member admits but impedes liquid flow in the circumferential direction of the rotor.

12. A centrifugal rotor according to claim 11, in which said niches (23) are formed in said other one of the end walls (1, 2) of the casing and said at least one liquid entrainment member (25) extends out into a niche (23) and bridges the whole radial extension of the niche, whereas the additional liquid entrainment member (26) situated between two niches (23) extends radially outwardly only to the same level as said outlets (24).

13. A centrifugal rotor according to claim 11, in which all of the liquid entrainment members (25, 26) are formed in one piece with said partition (9).

* * * * *